US009757871B2

(12) United States Patent
Burke et al.

(10) Patent No.: US 9,757,871 B2
(45) Date of Patent: Sep. 12, 2017

(54) FENCES FOR TABLE SAWS

(71) Applicant: SD3, LLC, Tualatin, OR (US)

(72) Inventors: Jeremy J. Burke, Sherwood, OR (US); John P. Nenadic, Camas, WA (US); Stephen F. Gass, West Linn, OR (US); J. David Fulmer, West Linn, OR (US)

(73) Assignee: SD3, LLC, Tualatin, OR (US)

( * ) Notice: Subject to any disclaimer, the term of this patent is extended or adjusted under 35 U.S.C. 154(b) by 194 days.

(21) Appl. No.: 14/517,469

(22) Filed: Oct. 17, 2014

(65) Prior Publication Data

US 2015/0107428 A1 Apr. 23, 2015

Related U.S. Application Data

(60) Provisional application No. 61/892,237, filed on Oct. 17, 2013.

(51) Int. Cl.

| | |
|---|---|
| ***B27B 27/10*** | (2006.01) |
| ***B27B 27/02*** | (2006.01) |
| ***B27B 5/22*** | (2006.01) |

(52) U.S. Cl.

CPC ..... *B27B 27/10* (2013.01); *B27B 5/222* (2013.01); *B27B 27/02* (2013.01); *Y10T 83/727* (2015.04)

(58) Field of Classification Search

CPC ..... Y10T 83/727; Y10T 83/728; Y10T 83/73; Y10T 83/741; Y10T 83/743; Y10T 83/7593; Y10T 83/76; Y10T 83/7613; Y10T 83/7627; Y10T 83/773; B26D 7/01; B27B 27/10; B27B 27/02; B27B 27/00; B27B 5/22; B27B 5/222

See application file for complete search history.

(56) References Cited

U.S. PATENT DOCUMENTS

| | | | | |
|---|---|---|---|---|
| 1,938,548 A | | 12/1933 | Tautz | |
| 1,963,688 A | | 6/1934 | Tautz | |
| 1,993,219 A | | 3/1935 | Merrigan | |
| 2,075,282 A | | 3/1937 | Hedgpeth | |
| 2,106,288 A | | 1/1938 | Tautz | |
| 2,521,302 A | * | 9/1950 | Musselman | B23Q 3/005 144/253.1 |
| 2,556,548 A | | 6/1951 | Modderman | |
| 2,562,246 A | * | 7/1951 | Van Dam | B23Q 3/005 144/253.1 |
| 2,590,035 A | | 3/1952 | Pollak | |
| 2,622,637 A | | 12/1952 | Gustin | |

(Continued)

OTHER PUBLICATIONS

SI16WA-WF Circular Saw with Tilting Blade Spare Parts Catalogue, SCMI Corporation, Norcross, GA, Nov. 1986 and 1991.

(Continued)

*Primary Examiner* — Phong Nguyen

(57) ABSTRACT

Fences for use in table saws are disclosed. One embodiment may include an actuator, handle or lever to lock and unlock the fence from the table, where the actuator, handle or lever is positioned substantially above the tabletop and substantially within the perimeter of the table (including any rail associated with the table). Another embodiment may include an actuator, handle or lever to lock and unlock the fence from the table, where the actuator, handle or lever is positioned along a top surface of the fence and configured so that the fence unclamps from the saw when the actuator, handle or lever is pressed.

3 Claims, 11 Drawing Sheets

(56) References Cited

U.S. PATENT DOCUMENTS

| | | | | |
|---|---|---|---|---|
| 2,695,638 | A | 11/1954 | Gaskell | |
| 2,744,549 | A * | 5/1956 | Johnson | B23Q 3/005 144/253.1 |
| 2,852,047 | A | 9/1958 | Odlum et al. | |
| 2,945,516 | A | 7/1960 | Edgemond, Jr. et al. | |
| 3,011,531 | A | 12/1961 | Gaskell | |
| 3,021,881 | A | 2/1962 | Edgemond, Jr. et al. | |
| 3,565,137 | A | 2/1971 | Alsruhe | |
| 3,845,676 | A | 11/1974 | Pierce | |
| 3,953,770 | A | 4/1976 | Hayashi | |
| 4,206,910 | A | 6/1980 | Biesemeyer | |
| 4,294,147 | A | 10/1981 | Borzym | |
| 4,658,687 | A * | 4/1987 | Haas | B27B 27/02 269/238 |
| 4,846,036 | A * | 7/1989 | Metzger, Jr. | B23Q 1/0063 83/438 |
| 4,964,450 | A | 10/1990 | Hughes et al. | |
| 5,116,249 | A | 5/1992 | Shiotani et al. | |
| 5,230,269 | A | 7/1993 | Shiotani et al. | |
| 5,293,802 | A | 3/1994 | Shiotani et al. | |
| 5,379,816 | A | 1/1995 | Charlton | |
| 5,464,184 | A | 11/1995 | Folci | |
| 5,647,258 | A | 7/1997 | Brazell et al. | |
| 5,722,308 | A | 3/1998 | Ceroll et al. | |
| 5,927,857 | A | 7/1999 | Ceroll et al. | |
| D422,290 | S | 4/2000 | Welsh et al. | |
| 6,062,121 | A | 5/2000 | Ceroll et al. | |
| 6,148,703 | A | 11/2000 | Ceroll et al. | |
| 6,161,459 | A | 12/2000 | Ceroll et al. | |
| 6,250,190 | B1 | 6/2001 | Ceroll et al. | |
| 6,357,328 | B1 | 3/2002 | Ceroll et al. | |
| 6,450,077 | B1 | 9/2002 | Ceroll et al. | |
| 6,460,442 | B2 | 10/2002 | Talesky et al. | |
| 6,484,614 | B1 | 11/2002 | Huang | |
| 6,484,767 | B2 | 11/2002 | Cameron | |
| 6,575,067 | B2 | 6/2003 | Parks et al. | |
| 6,581,655 | B2 | 6/2003 | Huang | |
| 6,601,493 | B1 | 8/2003 | Crofutt | |
| D479,538 | S | 9/2003 | Welsh et al. | |
| 6,640,683 | B2 | 11/2003 | Lee | |
| 6,644,157 | B2 | 11/2003 | Huang | |
| 6,647,847 | B2 | 11/2003 | Hewitt et al. | |
| 6,736,042 | B2 | 5/2004 | Behne et al. | |
| 6,854,371 | B2 | 2/2005 | Yu | |
| 6,986,370 | B1 | 1/2006 | Schoene et al. | |
| 7,441,487 | B2 * | 10/2008 | Liu | B23D 47/025 83/438 |
| 2002/0050201 | A1 | 5/2002 | Lane et al. | |
| 2005/0087049 | A1 | 4/2005 | Miller | |
| 2006/0130623 | A1 | 6/2006 | Ceroll et al. | |
| 2008/0236355 | A1 | 10/2008 | Gass et al. | |

OTHER PUBLICATIONS

Inca 2100SE Professional Tablesaw Owners Manual, Injecta Machinery, 1992.
Skil Model 3400-Type 1 10" Table Saw Parts List and Technical Bulletin, S-B Power Tool Company, Jun. 1993.
*Building a Clone of a Biesemeyer Table Saw Fence*, Swensen, 1996, 2006.
Shop Fox® Fence Operating Manual, Woodstock International, Inc., 1996, revised May 1997.
SI320 Circular with Tilting Blade Spare Parts Catalogue, SCM, Dec. 23, 1998.
SI3200/3800 Circular with Tilting Blade Spare Parts Catalogue, SCM, Dec. 23, 1998.
Grizzly Industrial, Inc. Heavy-Duty 12" Table Saw Model G5959 and G9957 Parts List, 1998 and Oct. 2001.
Excaliber T-Slot Precision Saw Fence Model TT45 Owner's Manual, Sommerville Design & Manufacturing, Inc., May 2000.
SI300N Circular with Tilting Blade Spare Parts Catalogue, SCM, Jun. 12, 2000.
Bosch Model 4000 Worksite Table Saw Operating/Safety Instructions, S-B Power Tool Company, Jul. 2000.
SI400N Circular with Tilting Blade Spare Parts Catalogue, SCM, Sep. 19, 2000.
DeWalt Woodworker's Table Saw DW746 Instruction Manual, DeWalt Industrial Tool Co., 2000.
SC 3W Circular Saw Manual, SCM Group S.p.A Divisione Minimax—Samco, Feb. 2001.
Ryobi 10" Table Saw BT3000 Operator's Manual, Ryobi Technologies, Inc., Mar. 2001.
XACTA Fence II™ Homeshop 30/52 Owner's Manual, JET Equipment & Tools, Mar. 2001.
XACTA Fence II™ Commercial 30/50 Owner's Manual, JET Equipment & Tools, Mar. 2001.
SI450E Circular with Tilting Blade Spare Parts Catalogue, SCM, Apr. 26, 2001.
Bosch 10" Table Saw Model 0601476139 Parts List and Technical Bulletin, S-B Power Tool Company, Apr. 2001.
Biesemeyer® T-Square® Universal Home Shop Fence system Instruction Manual, Delta Machinery, Jun. 1, 2001.
Powermatic 10" Tilting Arbor Saw Model 66 Instruction Manual & Parts List, JET Equipment & Tools, Jun. 2001.
Powermatic Accu-Fence for the Models 66, 72A & 74A Table Saws, Instruction Manual & Parts List, JET Equipment & Tools, at least as early as 2002.
Skil Model 3400 Table Saw Operating/Safety Instructions, S-B Power Tool Co., Sep. 2001.
Ryobi 10" Table Saw BT3100 Operator's Manual, Ryobi Technologies, Inc., Aug. 2002.
Rojek Circular Saw PK 300 Spare part catalogue, Apr. 14, 2003.
Ridgid TS3650 Operators Manual 10" Cast Iron Table Saw, May 2003, Jun. 2003 and Jul. 15, 2003.
Porter-Cable Double Insulated 10" Bench Top Table Saw Instruction Manual, Porter-Cable Corporation, Sep. 15, 2003.
SI300S-SI30054 Circular with Tilting Blade Spare Parts Catalogue, SCM, Oct. 30, 2003.
INCRA Incremental Micro Precision Table Saw Fence Owner's Manual, Taylor Design Group, Inc., 2003.
Craftsman® Power and Hand Tools, pp. 142-143, 2003.
Shop Fox® Models W2005, W2006, W2007 Classic Fence Instruction Manual, Woodstock International, Jan. 2000, revised Mar. 2004.
ACCU-FENCE® 64A Fence and Rail System Owner's Manual, WMH Tool Group, Sep. 2004.
Unifence™ Saw Guide Instruction Manual, Delta Machinery, Feb. 22, 2005.
Biesemeyer® T-Square® Commercial Fence System Instruction Manual, Delta Machinery, May 2, 2005.
Powermatic WMH Tool Group Operating Instructions and Parts Manual 10-inch Cabinet Saw Model 2000, Nov. 2005.
Makita Model 2704 Exploded Drawings and Parts List, Nov. 2005.
Porter-Cable 10" Portable Table Saw 3812, Porter-Cable Corporation, 2005.
Porter Cable 10" Portable Table Saw Model 3812 Parts List with Guard Exploded View, 2005.
Grizzly Industrial, Inc. Model G0605X/G0606X Extreme Series 12" Table Saw Owner's Manual, Grizzly Industrial, Inc., Oct. 2006.
SCM SI 450 Circular saw with tilting blade product brochure, Villa Verucchio, Italy, undated.
SCM Group publication, Rimini, Italy, undated.
Makita Table Saw 2704 Instruction Manual, Makita Corporation of America, date unknown.
Laguna Tools table saw owner's manual, date unknown.

* cited by examiner

FENCES FOR TABLE SAWS

CROSS-REFERENCE TO RELATED APPLICATION

This application claims the benefit of and priority from U.S. Provisional Patent Application Ser. No. 61/892,237, filed Oct. 17, 2013, which is incorporated herein by reference.

TECHNICAL FIELD

The present specification relates to fences for table saws. More specifically, this specification relates to fences that are easy to use and ergonomical.

BACKGROUND

A table saw is a power tool used to cut a work piece to a desired size or shape. A table saw includes a work surface or table and a circular blade extending up through the table. A person uses a table saw by placing a work piece on the table and feeding it into contact with the spinning blade to cut the work piece to a desired size. The table saw is one of the most basic machines used in woodworking.

Often a person using a table saw moves a work piece into contact with the spinning blade by sliding the work piece along a guide called a fence. The fence mounts to the top of the table saw and provides a fixed reference surface relative to the blade against and along which the work piece can slide. The fence helps keep the work piece moving in a straight path without shifting or rotating. The fence can be positioned at various positions relative to the blade so that a work piece can be cut to different dimensions.

DETAILED DESCRIPTION

Figure 1:
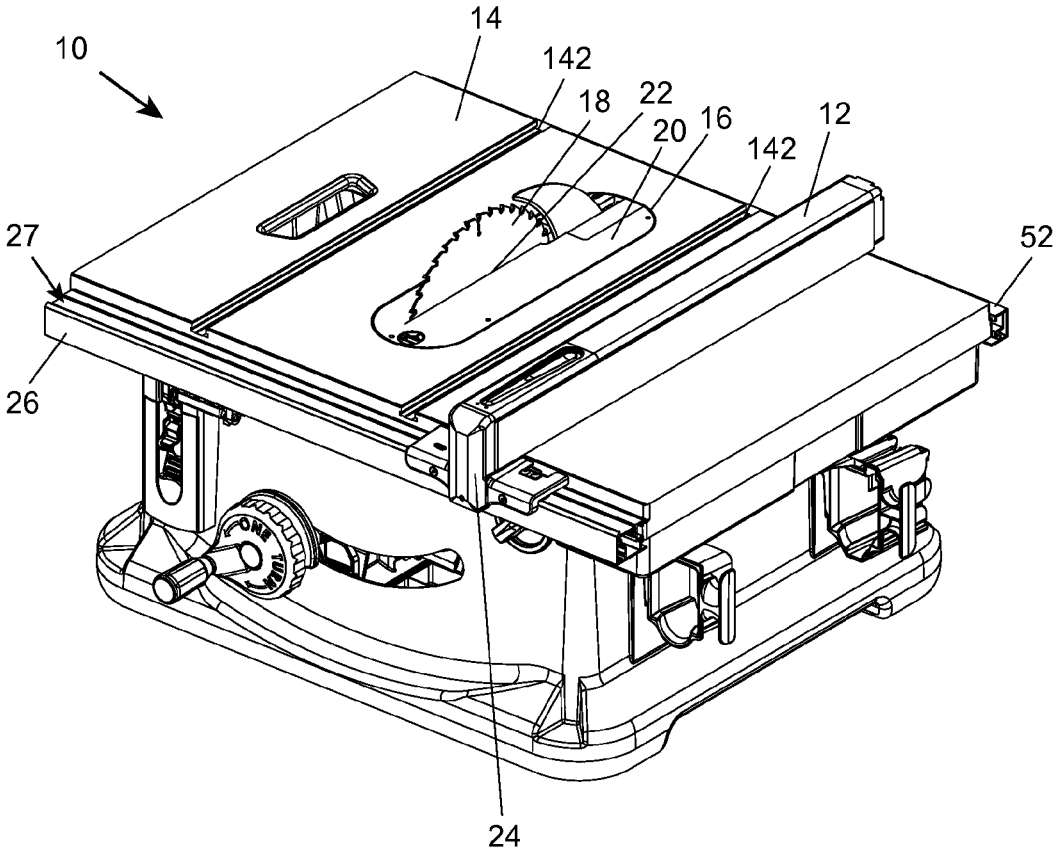
FIG. 1 shows a table saw with a table saw with a fence.

FIG. 1 shows a table saw 10 with a fence 12 installed. The table saw includes a table 14 and the top of the table defines a work surface. Table 14 includes an opening 16, and a blade 18 extends up through the opening 16. An insert 20 is placed in the opening to fit around the blade. The blade extends through a slot 22 in the insert.

Fence 12 is positioned on or over the top surface of table 14 and the fence extends from the front to the rear of the table. Table saw 10 includes a front rail 26 positioned along the front of the saw just below the top of table 14, and fence 12 includes a head portion 24 that extends down to the front rail 26. The fence head 24 may be locked to the front rail 26 to hold the fence securely in place or unlocked to allow the fence to slide along the front rail and table. The fence may be positioned on either side of the blade.

Figure 2:
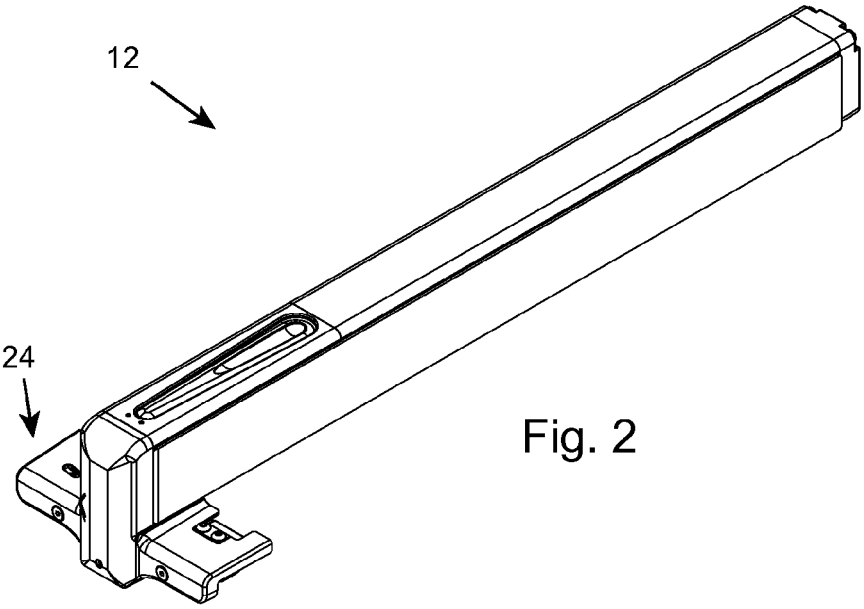
FIG. 2 shows a fence.
Figure 3:
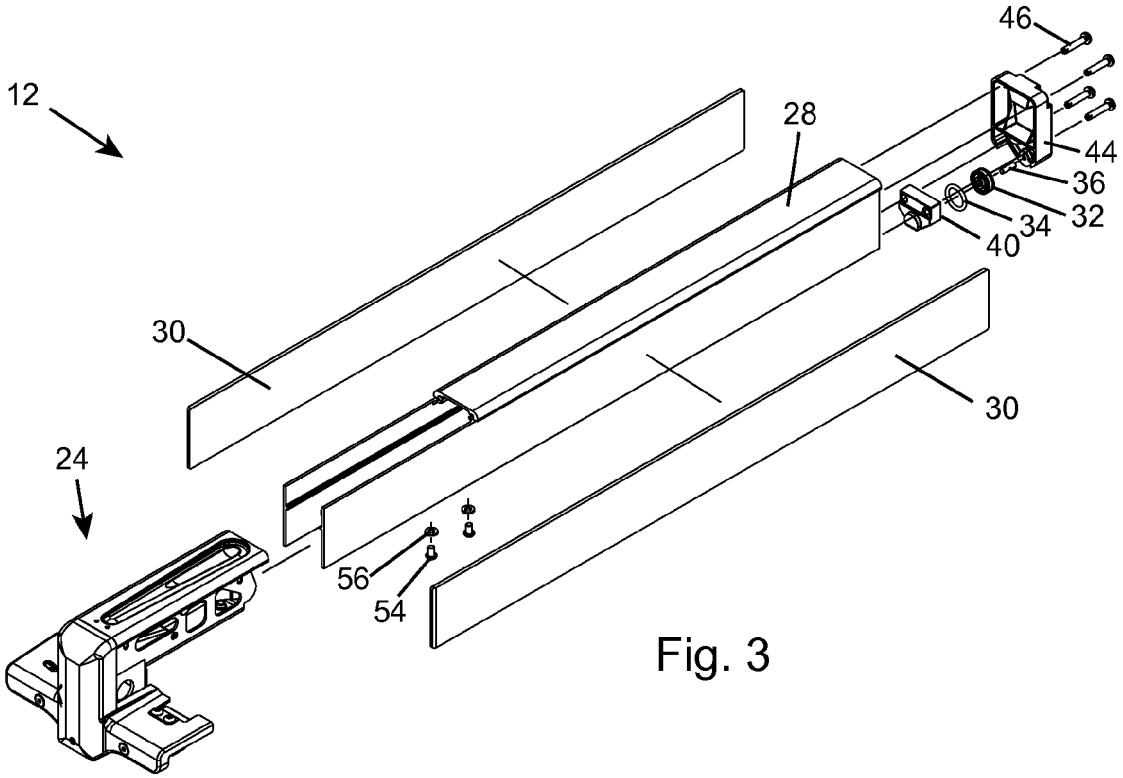
FIG. 3 shows an exploded view of the fence of FIG. 2.

FIG. 2 shows fence 12 isolated and FIG. 3 shows an exploded view of the fence. Fence 12 is composed of a fence head 24 which is attached to a hollow rectangular tube 28. Face plates 30 cover the right and left sides of the tube and provide a flat, smooth surface along which a work piece can slide as the work piece moves past the blade.

At the end of the tube opposite the fence head there is a roller 32 with a rubber insert 34 that fits in a groove along the circumference of the roller 32 and which is secured to the end of the tube 28 by a pin 36 which passes through the center of the roller and is supported at one end in a cylindrical cavity in a roller block 40 and at the other end in a cylindrical cavity in an endcap 44. Endcap 44 is attached to the end of the tube 28 by four screws 46, one located generally at each corner of the endcap, the top two of which thread into holes near the top of the end of the tube and the bottom two pass through holes in roller block 40 and then thread into holes near the bottom of the end of the tube. Roller 32 sits within a large cylindrical shaped cavity in roller block 40 that is open at the bottom to allow the bottom of the roller to extend down below the bottom of tube 28 and roll along a rear rail 52 of the saw to support the distal end of the fence. A user may slide the fence toward or away from the blade on the table to place the fence in a desired position, and roller 32 facilitates the movement of the fence by rolling along the top of the rear rail and by supporting the distal end of the fence. The roller may be positioned to roll along the top of the table instead of along the top of the rear rail, in which case the roller may be larger or a second roller added so that the fence can roll over any slots in the table, such as a slot for a miter gauge.

The end of the fence near the front of the saw may be called a head unit or fence head, as previously mentioned. In the depicted embodiment, fence head 24 is generally shaped like a "T" when looking down at it from above, with the longer middle section of the "T" running along tube 28 and the shorter cross or arms of the "T" running along the front rail 26 of the saw, as shown in FIG. 1. The cross or arms are lower than the middle section of the "T" in order for the arms to rest or ride on the front rail 26, which is below the table top, and the longer middle section is positioned along or slightly above the top of the table.

Fence head 24 attaches to the bottom of tube 28 by two screws 54. Those screws pass through lock washers 56 and then through holes in the bottom of the tube 28 and then thread into holes in the bottom of the fence head.

The components of the fence head 24 and how they fit together are shown in FIGS. 4, 5, 6 and 7. As can be seen in the exploded view of FIG. 4, the fence head 24 has a front cover 60 and a top cover 62. Front cover 60 covers each arm on either side of the middle section of the fence head 24 and also covers the front of the fence head. Two screws 64 pass horizontally through holes 66, one hole through the front of each side arm, and thread into holes 68 in an internal structure 70 to secure the front cover 60 to the internal structure 70. Of course, additional screws and/or clips can be used to secure the front cover to the internal structure. In the depicted embodiment, internal structure 70 is a frame or weldment composed of three pieces welded together, and it provides the basic shape of the fence head. The top cover 62, which has a rectangular shape when viewed from the top, runs along the top of the fence head and has a cutout 72 shaped like a long, narrow oval of a greater radius at the end farthest from the front of the fence. Cutout 72 surrounds the top of a locking lever 74 that allows the user of the saw to clamp and unclamp the fence to the front rail. Top cover 62 has a lip 76 along the front edge that fits under the end of the front cover 60 and also a similar lip along the back edge that fits under the end of the tube 28 so that the pieces mate together without gaps between them.

Figure 4:
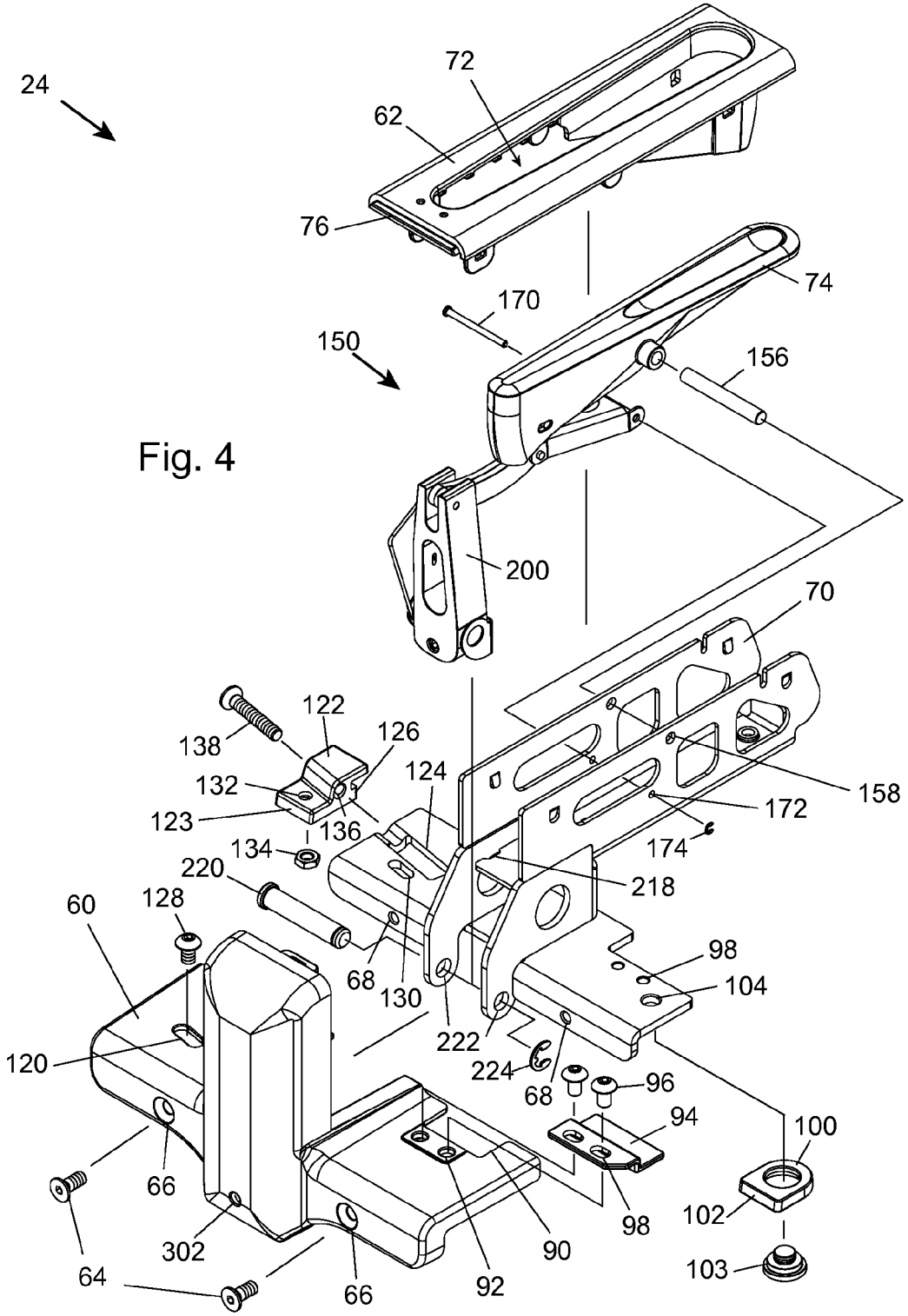
FIG. 4 shows an exploded view of a fence head.
Figure 5:
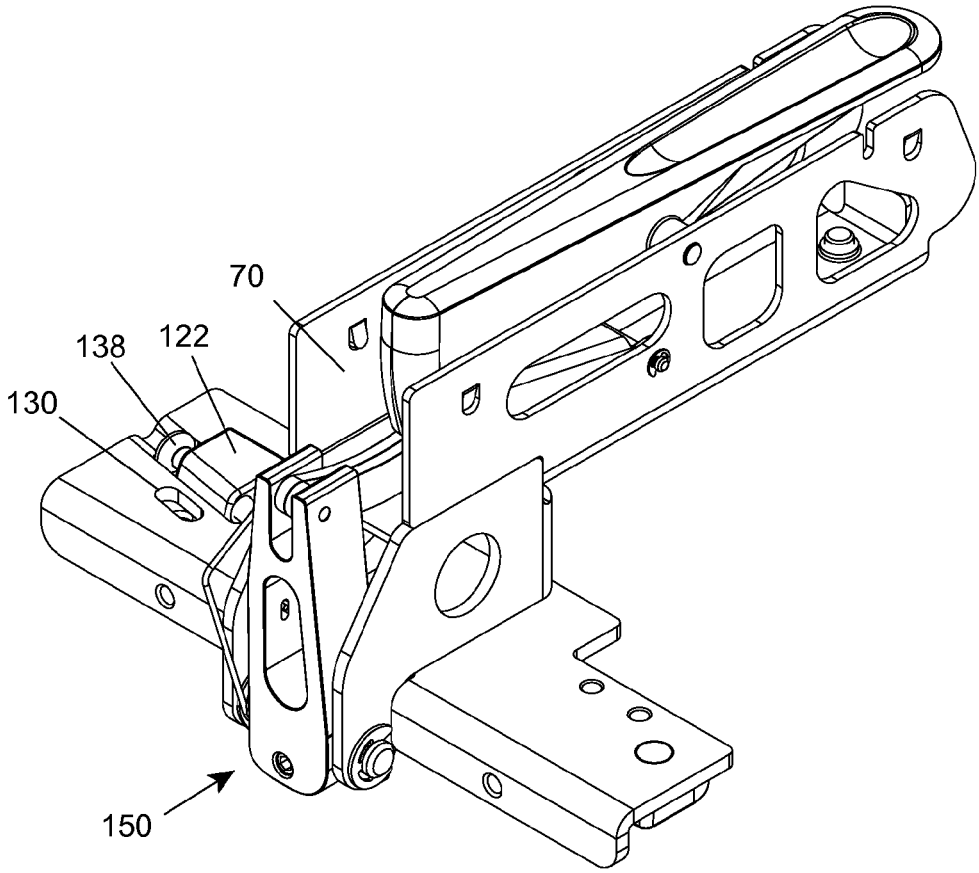
FIG. 5 shows a view of parts used in the fence head of FIG. 4.

On the right side of the front cover 60, as seen in FIG. 4, there is a rectangular shaped cutout 90 along the rear edge with two holes 92 along the inside edge of the long side of the cutout. A generally rectangular shaped transparent plastic indicator lens 94 is placed under the cutout 90. Lens 94 has a flat raised section running lengthwise that steps down and joins a lower section running lengthwise. The indicator lens 94 attaches to the fence head 24 by two screws 96 which pass through holes 92 on the top of the front cover, then through slightly oval holes 98 in the raised section of the indicator lens, and then thread into two holes 98 in the internal head structure 70. The lens can be used with a ruler on the front rail to measure the position of the fence relative to the blade. A similar lens can be implemented on the other side of the fence head, if desired.

In the depicted embodiment, on the left side of the front cover, there is a slot 120 shaped like a rectangle with the short sides rounded, located on the top of the cover running diagonally such that it moves closer to the front of the front cover while moving inwards towards the middle of the front cover. A slider block 122, that has a rectangular shape looking down from above and a stair-step shape when looking from the side, with the step running along a diagonal line as seen from above, is positioned such that the lower part of the step fits under the internal structure 70 and the upper part sits on top of the internal structure. Internal structure 70 has a diagonal running slot 124, best seen in FIG. 4, for the slider block to fit through. A small ledge 126 extends out from the slider block below the upper step and slips under the internal structure 70. A screw 128 passes through the diagonal slot 120 in the front cover, then through a similar sized and shaped diagonal slot 130 in the internal structure directly below the diagonal slot in the front cover, then through a hole 132 in the lower step of the slider block, and then threads into a nut 134 to secure the slider block to the fence head in such a way that the slider block 122 may be moved along the diagonal slots 120 and 130. There is a threaded hole 136 running through the middle portion of the slider block along and just underneath the surface of the diagonal step into which a screw 138 enters from the outside edge of the fence head. The top of the internal structure 70 dips down under screw 138 to make room for the screw.

The screw 138 allows for adjustment of the fence head with respect to the front rail 26, and thus allows for the adjustment of the fence tube 28 with respect to the table 14 and the blade 18. As the screw is rotated slightly, the slider block is pulled to the left or moved to the right depending on which way the screw is rotated. The surface along the rear of the ledge 126 abuts an edge of the front rail on the saw, and since the screw is at a diagonal, the slider moves along a diagonal as screw 138 turns so that ledge 126 moves closer to or farther away from the front rail on the saw. That causes a slight turning or twisting of the fence in relation to the front rail, which thereby allows the fence to be adjusted so that plates 30 are parallel to the plane of the blade and so that tube 28 is parallel to the miter slots 142 in the table of the saw. When the fence is properly aligned by turning screw 138, the position of slider block 122 can be locked in place by tightening screw 128.

The bottom of slider block 122 contacts the top of front rail 26 to support the fence on the rail. In the depicted embodiment, front rail 26 includes a channel 27 extending along the top of the front rail, and the bottom of slider block 122 fits in the channel. Slider block 122 can be made of plastic to facilitate the fence sliding on the front rail. Slider block 122 also includes a front edge 123 that abuts an edge of channel 27 when the fence is clamped on the front rail. Edge 123 and the corresponding edge of channel 27 can be angled slightly to inhibit the fence from moving up when the fence is clamped to the rail.

A support 100 for the fence is located on the bottom of the right side of the fence head. Support 100 contacts the top of front rail 26, and together with slider block 122, helps support the fence on the rail. Support 100 is shaped to fit within channel 27 on the front rail, and like the slider block, can be made of plastic to facilitate the fence sliding on the rail. Support 100 includes a front edge 102 that abuts the same edge of channel 27 as front edge 123 on slider block 122. Front edge 102 on support 100 can also be angled to correspond to the angle of the edge of channel 27 to inhibit the fence from moving up when the fence is clamped to the rail, similar to front edge 123 on slider block 122. Support 100 is secured to internal head structure 70 by a screw 103 that passes through a hole in support 100 and then threads into hole 104 in internal structure 70.

Figure 6:
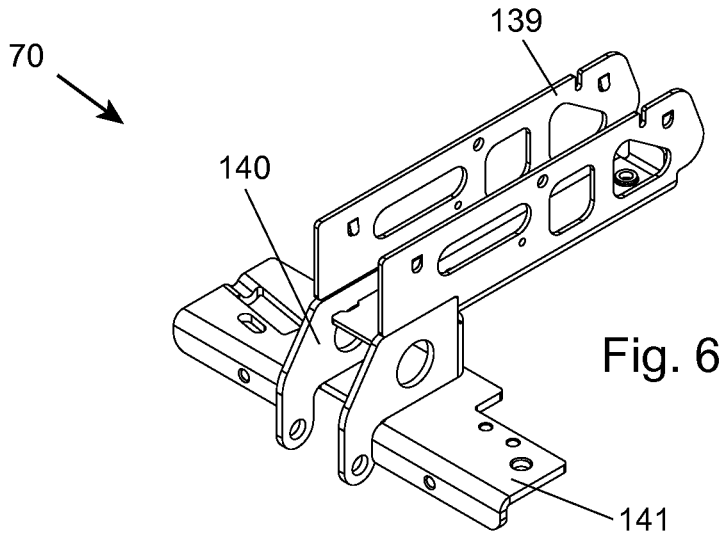
FIG. 6 shows an internal structure used in the fence head of FIG. 4.
Figure 7:
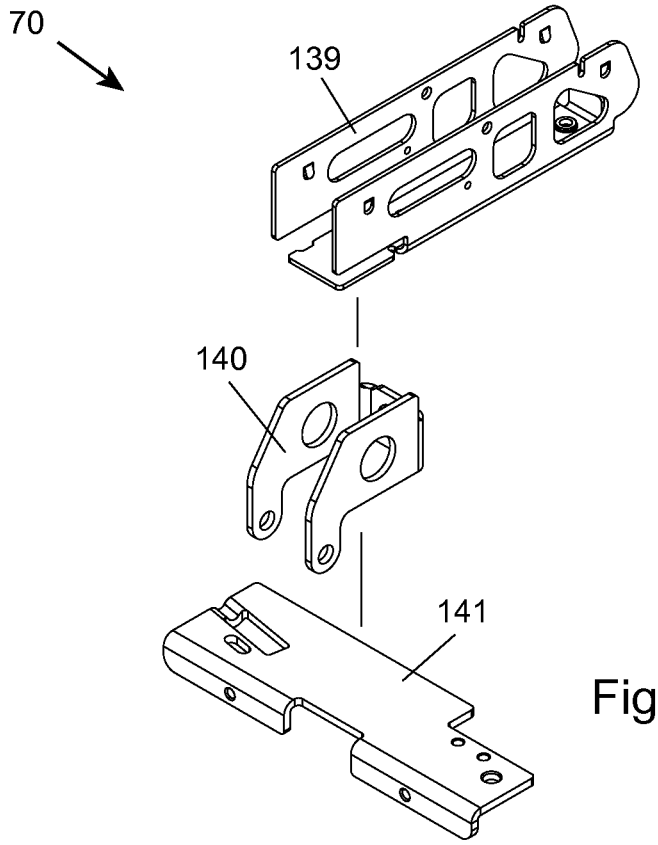
FIG. 7 shows an exploded view of the internal structure of FIG. 6.

Internal structure or frame 70 is shown isolated in FIGS. 6 and 7. As mentioned earlier, it consists of three sections welded together to form the structure of the fence head. There is a rectangular section 139 that has a bottom and two sides but is open on the top and this section runs along and within the front end of tube 28 with the top cover 62 covering the top. A connecting section 140 fits underneath one end of the rectangular section to join the rectangular section to a cross piece 141 that forms the lower arms that ride along the front rail 26. A clamp or locking mechanism 150 fits within the rectangular section and down the front of the internal structure 70 within the sides of the connecting section 140.

Figure 8:
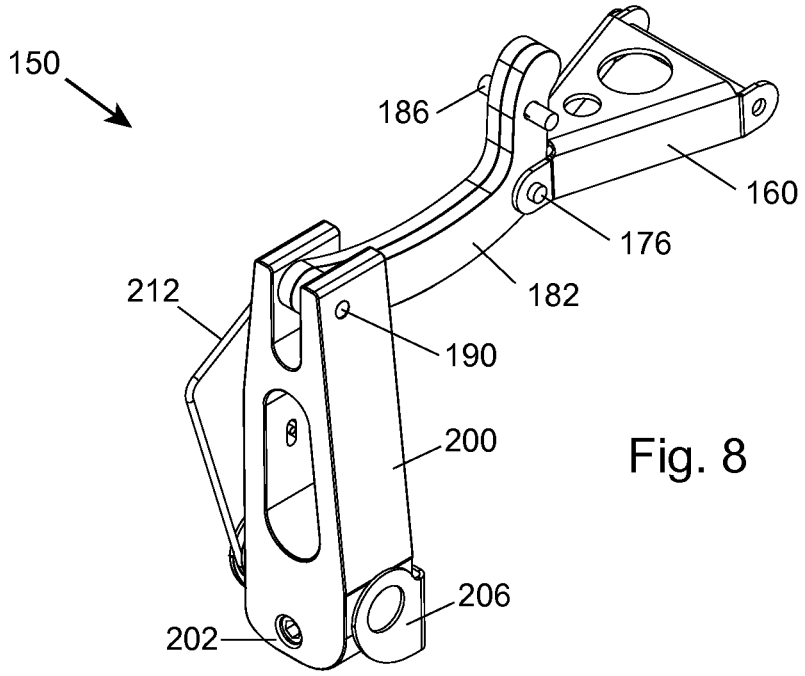
FIG. 8 shows a locking linkage.
Figure 9:
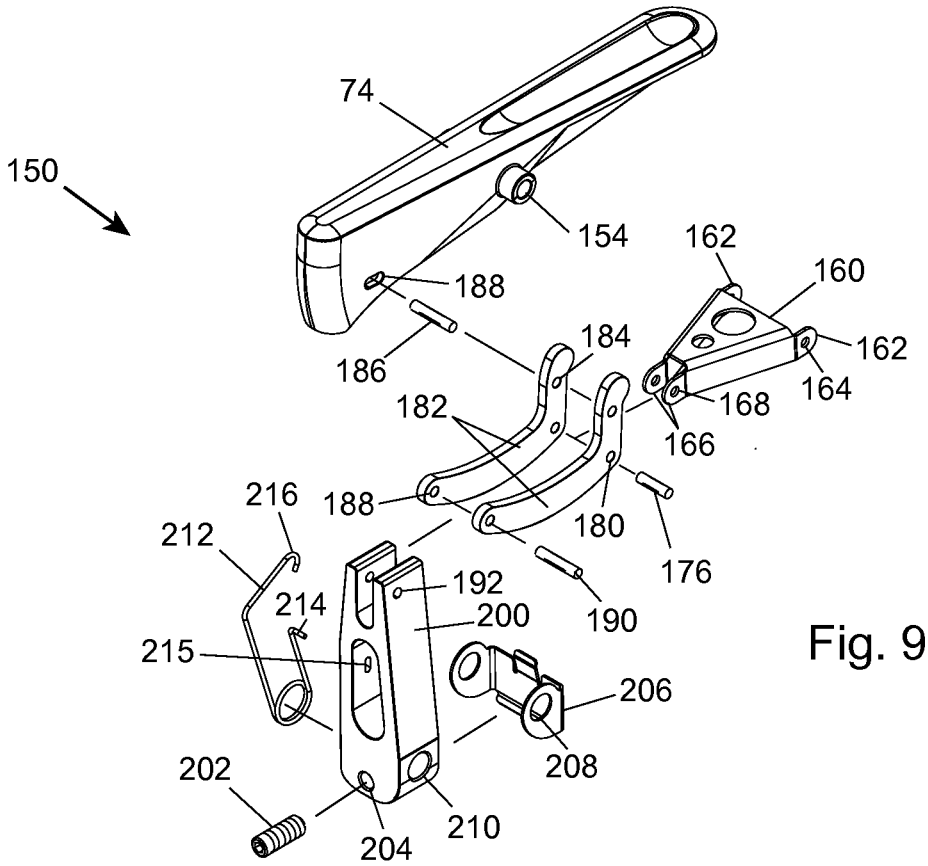
FIG. 9 shows an exploded view of a locking mechanism.

FIG. 8 shows the clamp or locking mechanism 150 isolated (although without locking lever 74, discussed below) and FIG. 9 shows an exploded view of the locking mechanism. The locking mechanism 150 consists of locking lever 74 with cylindrical stubs 154 extending out to each side of the locking lever from the middle. A pin 156 (shown in FIG. 4) fits through the cylindrical stubs 154 and through holes 158 near the top and middle of the internal structure 70 to attach the locking lever to the internal structure in such a way that the locking lever can rotate or pivot around pin 156. The locking lever is shaped so that it can move freely through the cutout 72 in the top cover 62 as the locking lever pivots.

Underneath the locking lever 74 there is a triangular shaped linkage 160 with two extensions 162 off each corner at the base with holes 164 through each extension. There are also two extensions 166 off the corner opposite the base that also have holes 168 through them. A pin 170 (shown in FIG. 4) with a head on one end runs parallel to the base of the triangular linkage 160 passing through the holes 164 in extensions 162 and through holes 172 in the internal structure 70 where it is secured in place with an e-clip 174.

In the depicted embodiment, a short pin 176 runs through one of the holes 168 in one of the extensions 166, then through a hole 180 in each of two flat links 182 that are situated side by side and positioned between extensions 166 on the triangular linkage 160, and then through the other hole 168 in the other triangular linkage extension 166. Each link 182 is a flat metal piece curved gently along one long side until it turns roughly perpendicularly upward at one end. Holes 180 are located in each link 182 approximately at the corner between the gently curved portion and the portion that turns upward, as shown in FIG. 9. Pin 176 pivotally attaches the triangular linkage 160 to the flat links 182, as shown. At the upward turning end of each flat link there is another hole 184, and a pin 186 passes through both holes 184. The ends of pin 186 extend out from the flat links and fit in a small oval slot 188 at the base of the front of the locking lever 74 so that the flat links pivot around pin 186 as the locking lever pivots. At the other end of each flat link 182 there is another hole 188 through which passes another pin 190, and each end of pin 190 fits into a hole 192 on either side of a locking block 200.

Locking block 200 extends up along the outside of the flat linkages 182, as shown in FIG. 8, and then down so that the bottom portion of the locking block is positioned in front of the front rail 26. A set screw 202 threads into a hole 204 at the bottom of the locking block and can be rotated to move the bottom portion of the locking block closer to or farther from the front rail. A locking plate 206, shaped like a short, flat plate bent approximately ninety degrees on both sides, has holes 208 through each side. Locking plate 206 fits over the lower portion of the locking block 200 and holes 208 align with a hole 210 in the locking block. A spring 212 lies along the left side of the locking block and is shaped like a loop with each end continuing out from the loop in a straight line parallel to each other until end 214 bends approximately ninety degrees to fit into a small hole 215 in the side of the locking block 200, and the other end, which is to the front of the locking block, bending a little less than ninety degree back toward end 214, continuing straight for about half the length of the straight segment exiting the loop, and then curling to form a hook 216 which fits into a small slot 218 (labeled in FIG. 4) along the left bottom edge of the internal structure 70 near the front of the rectangular section of the weldment. A pin 220 with a head on one end passes through a hole 222 at the bottom of the internal structure 70, then through a loop at the bottom of spring 212, then through one of the holes 208 in the locking plate 206, then through hole 210 in the locking block 200, then through the other hole 208 in the locking plate, and finally through another hole 222 in the internal structure 70. Pin 220 is secured in place by an e-clip 224, as shown in FIGS. 4 and 10.

Figure 10:
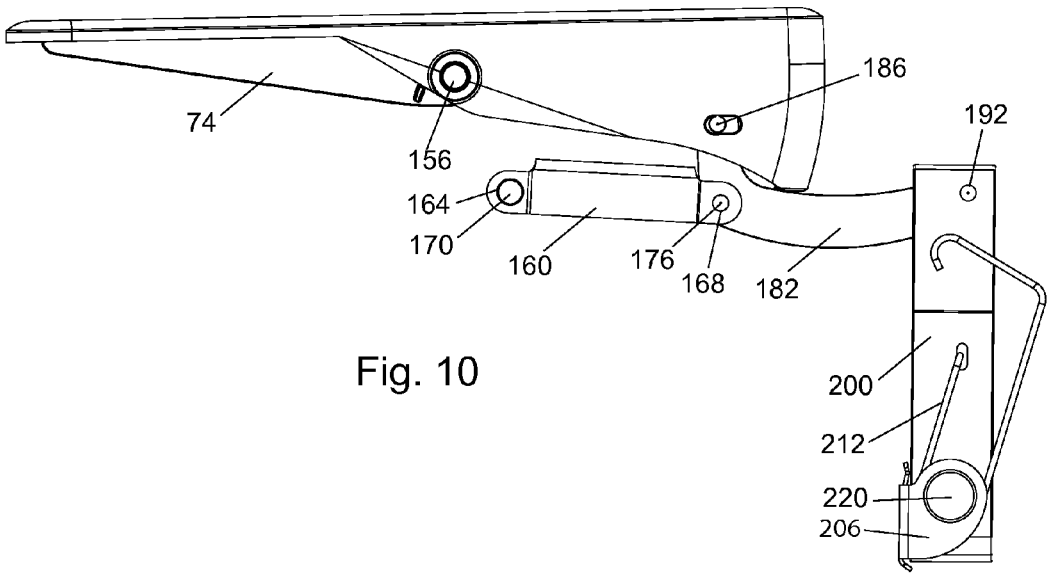
FIG. 10 shows a locking mechanism in a locked, clamped or closed position.
Figure 11:
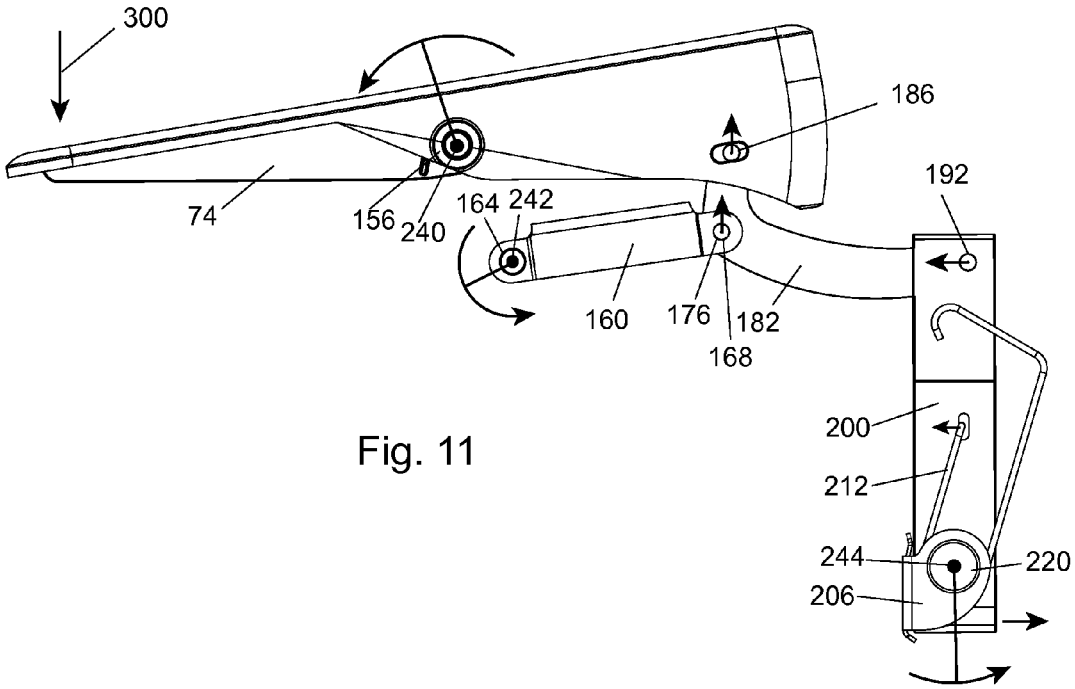
FIG. 11 shows a locking mechanism is an unlocked, unclamped or open position.

Clamp or locking mechanism 150 enables the fence to be securely clamped or locked to the front rail when the locking lever is in a horizontal position as shown in FIG. 10. In this locked configuration, holes 164 in the triangular linkage are generally along the same horizontal line as holes 192 in the locking block 200, while hole 168 in the triangular linkage is at or slightly below that line so that the top of the locking block is pushed outward and the bottom of the locking block, which pivots around pin 220, is pushed up against the front rail to clamp the fence to the front rail. To unlock the fence, the end of the locking lever 74 farthest from the front of the fence is pushed downward, as shown by arrow 300 in FIG. 11, thus raising pin 186, which pulls pin 176 upward and out of alignment with holes 164 in the triangular linkage and holes 192 in the locking block 200. That, in turn, draws the top of the locking block inward, and thus the bottom of the locking block is pushed outward away from the front rail to unclamp the fence head from the front rail. In FIG. 11, for clarity, the pivot points that are rigidly held in place by the internal structure 70 are shown with dots at 240, 242, and 244, and arrows near those locations indicate movement or pivots.

In use, fence 12 is placed on a saw, over the tabletop, with tube 28 extending from the front of the saw to the rear. The fence is supported at the front by slider block 122 and support 100 resting on front rail 26, and at the back by roller 32 and rubber insert 34 resting on rear rail 52. When the fence is placed on the saw, clamp or locking mechanism 150 is open, as shown in FIG. 11, with the bottom of locking block 200 extending out, away from the front of the saw so that fence head 24 can fit over the front rail. Also, with locking mechanism 150 open, slider block 122 and support 100 can be positioned or placed in channel 27 in the front rail.

A user then grasps the fence by hand adjacent locking lever 74, and slides the fence to the right or left until it is located at a desired position relative to blade 18. Grasping the fence over the locking lever is between the ends of the fence and near the center of gravity of the fence because the head portion has more mass than the fence tube, and as a result, grasping the fence over the locking lever reduces the tendency of the fence to twist or rotate when a user slides the fence into position. In other fences, a user grasps a handle extending out from the proximate end of the fence (i.e., the end nearest the front of the saw), and when the user applies a force to the handle to slide the fence into position, the distal end of the fence (i.e., the end furthest from the front of the saw) lags behind resulting is a jittering or rough motion rather than a smooth translational motion.

With locking mechanism 150 open, the proximate end of locking lever 74 (i.e., the end nearest the front of the saw) extends up above the top surface of tube 28, as shown generally in FIG. 11. When the fence is positioned as desired, the user locks or clamps the fence in place by simply pushing the locking lever down with the heel or palm of their hand. The user's hand is already over the locking lever because that is the natural position to grasp and move the fence, so depressing the locking lever with the heel or palm of the hand is a natural and simple movement and does not require the hand to be repositioned. Once the proximate end of locking lever 74 is depressed a small amount, the linkage connecting the locking lever to locking block 200 goes over-center (i.e., holes 168 move below the line defined by holes 164 in triangular shaped linkage 160 and holes 192 in the locking block) and clamps or locks the fence in place. Once closed, the linkage is stable and will not open until the locking lever pivots. In some embodiments, a spring could be used to bias the locking mechanism closed.

To unclamp or unlock the fence, a user simply presses or pushes down with a finger on the distal end of locking lever 74 (i.e., the end furthest from the front of the saw). Pushing down on the distal end of locking lever 74 moves the bottom of locking block 200 away from the front rail, as explained, to open the clamp. The locking mechanism is also stable in this open position because holes 168 move over-center. Accordingly, locking mechanism 150 may be thought of as being bi-stable, i.e., stable in both an open and closed position and configured so that the locking mechanism goes to either an open or closed position.

Spring 212 is configured to bias the locking mechanism open, so when the distal end of locking lever 74 pivots down enough to move holes 168 over-center, i.e., above the line between holes 164 and 192 (as seen in FIGS. 10 and 11), spring 212 helps open the clamp and holds the locking mechanism open. When a user pushes down on the distal end of locking lever 74, the user's hand is already over the fence so the user can simply grasp the fence and slide it to a desired position. The user can then simply bump the proximal end of the locking lever down with the heel of the user's hand to clamp the fence in place.

A locking mechanism as described herein can also be configured so that it automatically locks or clamps the fence to the saw when a user is not touching the locking lever. This may be thought of as an auto-lock feature because the fence automatically locks in place when a user releases or moves their hand away from the fence. Additionally, a locking mechanism can be configured to open when a user pivots a locking lever a first distance, and to close automatically when the user releases the locking lever, but the locking mechanism will stay open if the user pivots the locking lever a second distance greater than the first distance. With this configuration, a user can selectively open the locking mechanism and know that the fence will lock in place when the user removes their hand from the fence, or the user can open the locking mechanism and have it remain open when the user removes their hand from the fence. This latter situation would be useful if, for example, the user wanted to remove the fence from the saw.

The fences described herein are ergonomic and easy to use. A user can position the fence on the saw and then lock the fence in position without having to reposition their hand on the fence and without having to grasp a separate handle. In the depicted embodiment, this is due at least in part to the fact that the locking lever is positioned substantially or wholly between the ends of the elongate portion of the fence, and/or substantially above the saw table, and/or within the perimeter of the table (where the perimeter includes any rail or rails attached to the table), and/or at a location where it is natural to grasp the fence.

Providing a fence with a locking lever as described herein also promotes usability of the fence because the locking lever does not extend substantially above the top of tube 28 when the locking mechanism is closed or clamped, as seen generally in FIGS. 1 and 10. This allows a user to slide their hand along the top of the fence when guiding a work piece past the blade. Some woodworkers use their right hand to help hold a work piece in position against the fence as they push the work piece into contact with the blade, and they do this by placing part of their hand over the top of the fence while simultaneously holding the work piece against the fence. They then slide their right hand along the top of the fence to maintain the position of the work piece relative to the fence as they make the cut. Leaving the top of the fence unencumbered allows the hand to slide along the top of the fence. Additionally, having at least a portion of the locking lever extend up above the top of the fence or tube 28 when the locking mechanism is open or unlocked provides a visual and tactile indication to a user that the fence is not locked in position, and therefore the fence can move relative to the table. Similarly, in the embodiment described above, a portion of the locking lever is recessed or pressed down below the top of the fence tube, and that provides an additional visual and tactile indication that the fence is not locked in position.

Providing a fence with a locking lever at least partially above the table decreases the perimeter of the saw and therefore increases the clearance, maneuverability, storability and usability of the saw. With the locking lever positioned at least partially above the table, the need to watch out for a handle sticking out from the front of the saw when moving or storing the saw is eliminated, thereby making it is easier to move the saw through doorways and other tight places, and making it is easier to store the saw or place the saw in the back of a truck. The fence handle simply does not stick out from the saw, and therefore, the saw is easier to move around. Additionally, a user can stand closer to the front edge of the table saw because there is no fence handle to block the user from doing so, and standing closer to the front edge of the table saw makes it easier to control the movement of the work piece past the blade.

With a fence as described herein, the perpendicularity of the fence relative to the front of the table saw, and the parallelism between the face plates on the fence and the blade, are easy to adjust, as explained. Moving slider block 122 to the right or left adjusts the perpendicularity of the fence and aligns face plates 30 with the blade. After slider block 122 is moved, it may be necessary to adjust the position of locking block 200 to insure the locking block provides an appropriate or desired clamping pressure on the front rail. This is accomplished by turning screw 202, as explained. Front cover 60 includes a hole 302, shown in FIG. 4, to provide access to screw 202.

Figure 12:
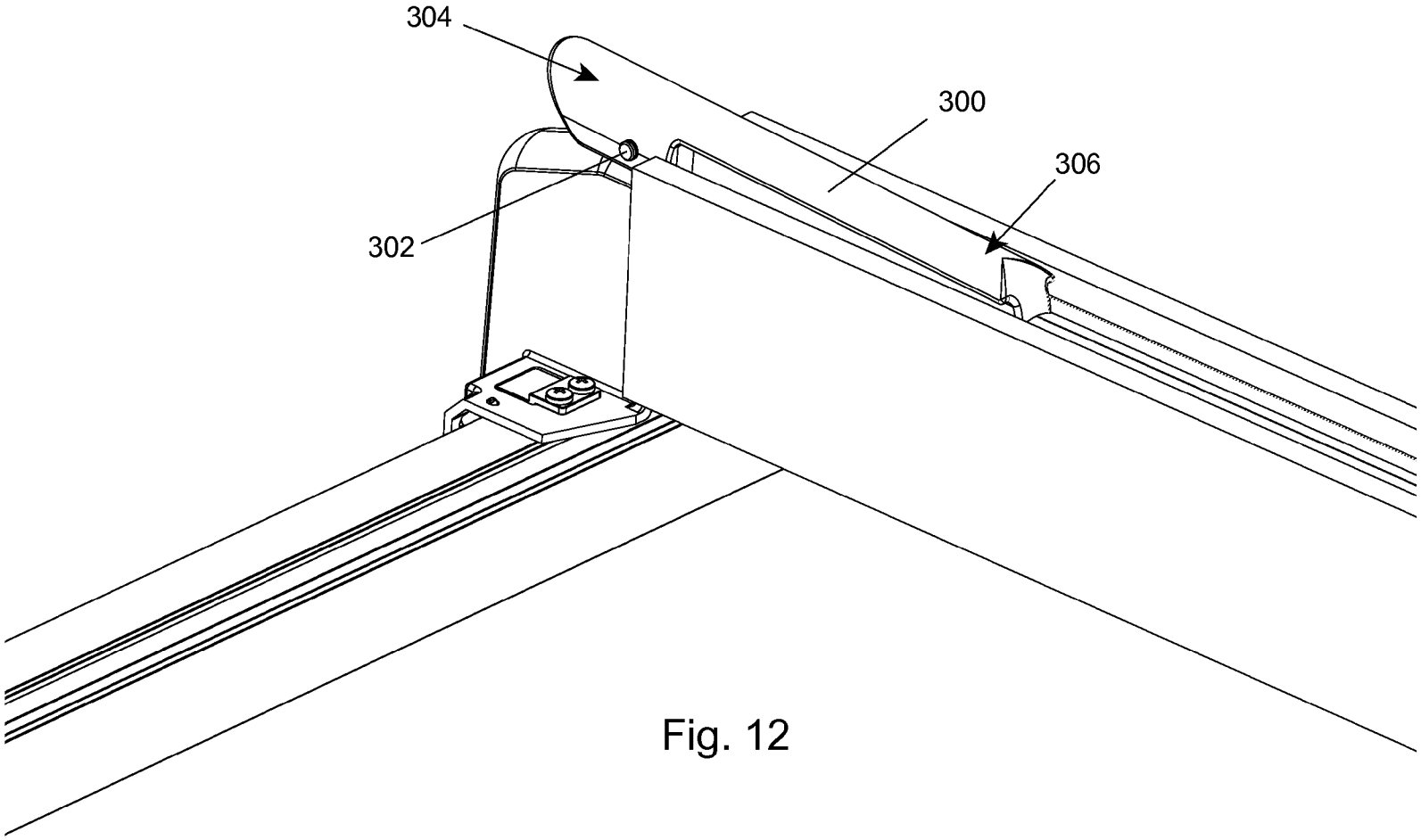
FIG. 12 shows an embodiment of a fence with a rocker that pivots around a pin.

FIG. 12 shows an embodiment of a fence with a rocker 300 that pivots around a pin 302. In this embodiment, a user can depress the proximate end 304 of the rocker to release or unclamp the fence and cause the distal end 306 to pop up. A user could press distal end 306 to lock or clamp the fence in position. In FIG. 12, rocker 300 is shown in the locked or clamped position.

Figure 13:
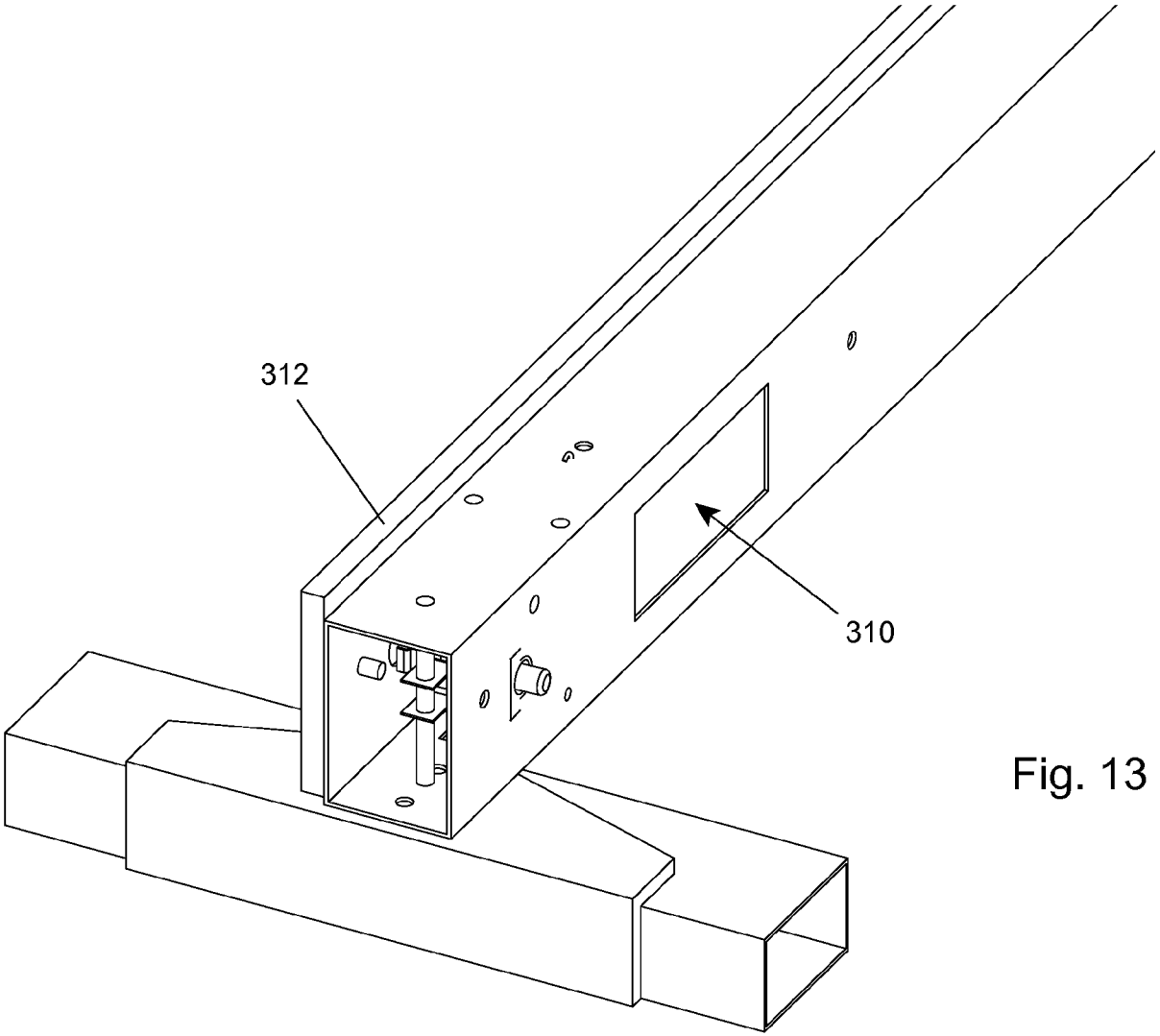
FIG. 13 shows an embodiment of a fence with a side actuator.

FIG. 13 shows an embodiment of a fence with a side actuator 310 on the right side of the fence tube. In this embodiment, a user squeezes side actuator 310 to release or unlock the fence, and continues to squeeze the actuator while sliding the fence into position. When the user releases the actuator, the fence auto-locks in position. This embodiment includes a removable face plate 312 that can be attached to the opposite side of the fence so that the fence can be used on the left side of the blade. A second side actuator is located on the left side of the fence tube opposite actuator 310 for this situation, and the second side actuator functions the same as actuator 310.

Figure 14:
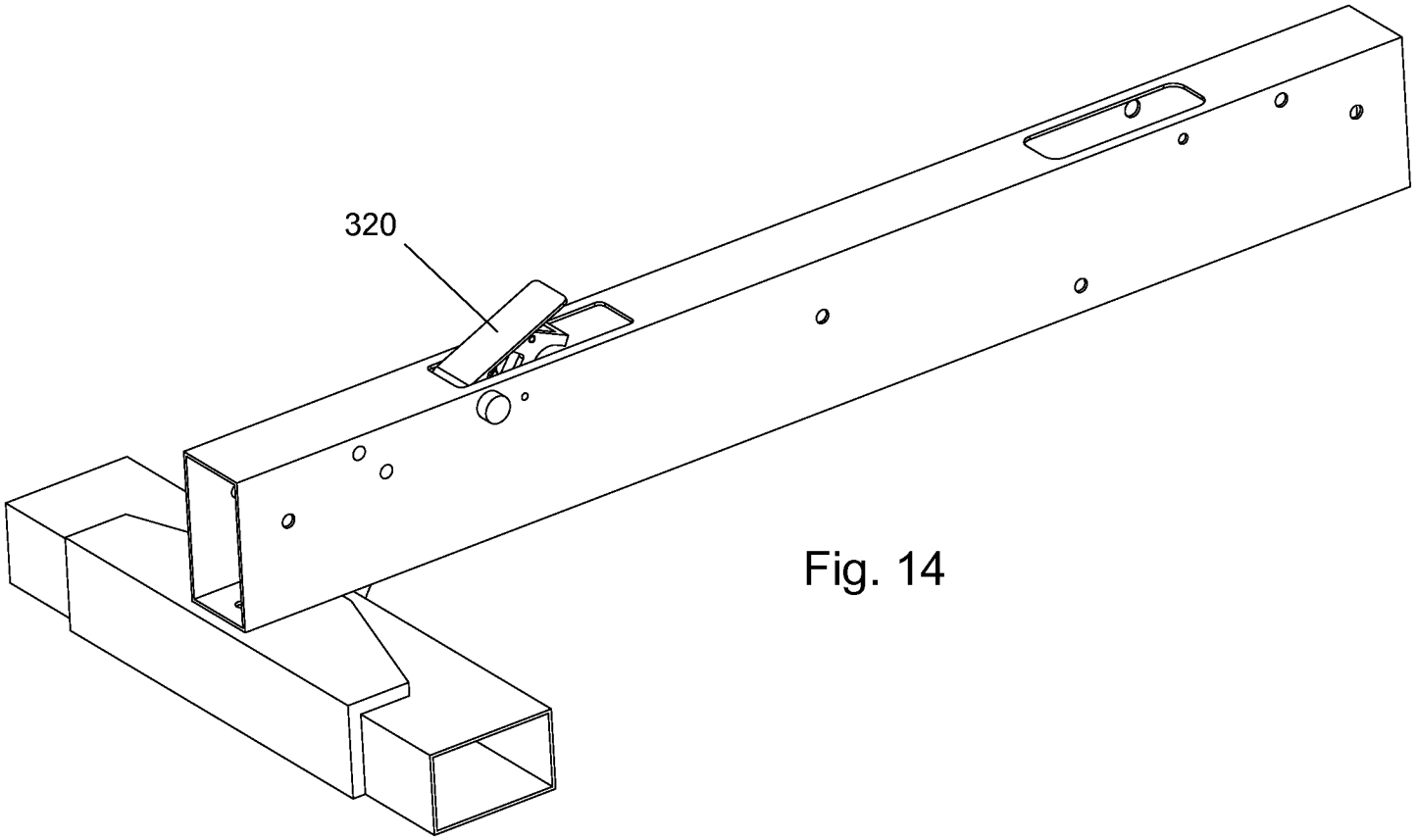
FIG. 14 shows an embodiment of a fence with a finger-pull actuator.

FIG. 14 shows an embodiment of a fence with a finger-pull actuator 320. In this embodiment, the fence is unclamped and free to move when a user pulls actuator 320 up, and the fence auto-locks in position when actuator 320 is released. Actuator 320 can be configured so that it is substantially flush with or below the top of the fence when the actuator is released, or at least not significantly above the top of the fence.

Figure 15:
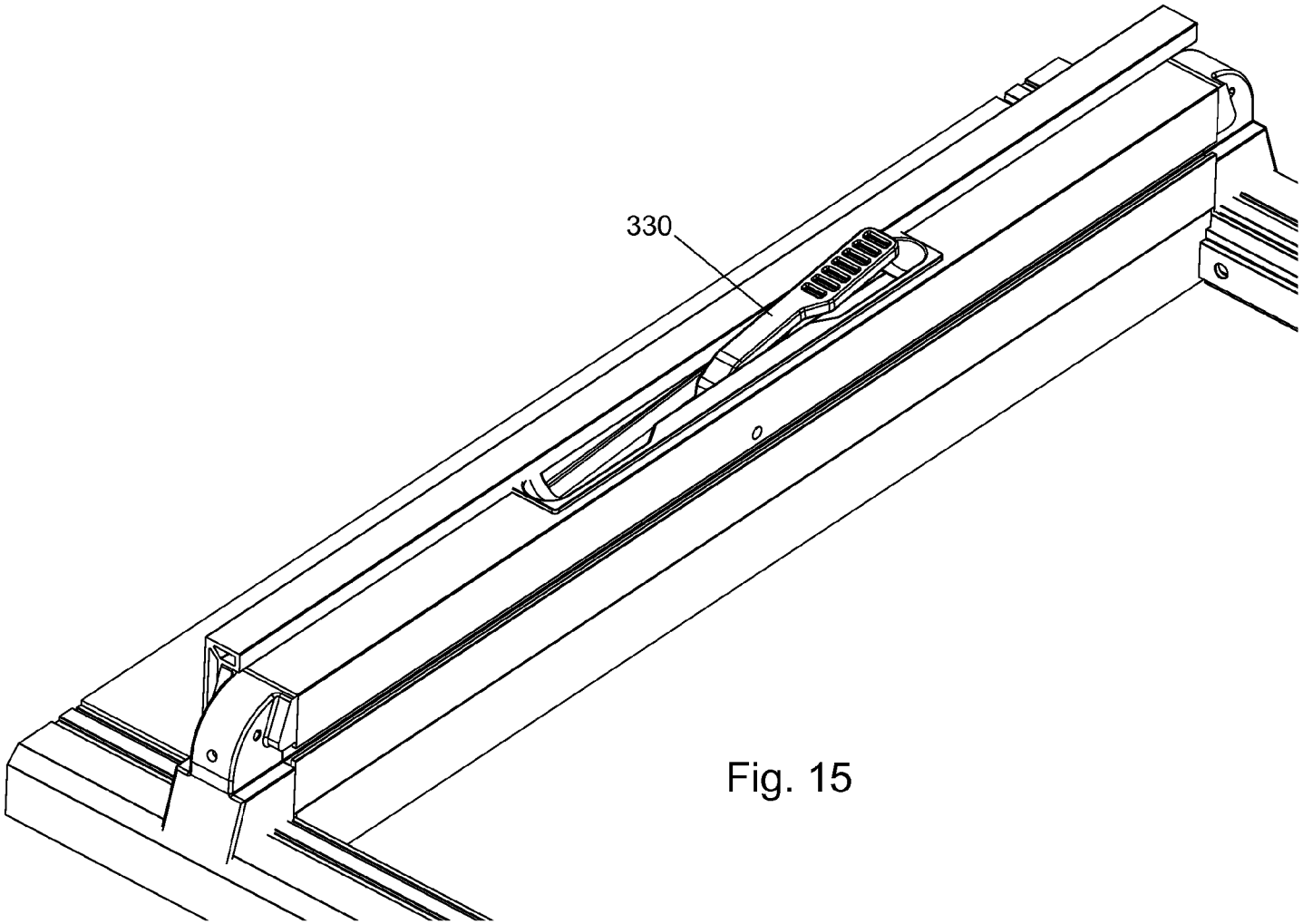
FIG. 15 shows an embodiment of a fence with a lever that can pivot both forward and backward to lock the fence in position.

FIG. 15 shows an embodiment of a fence with a lever 330 that can pivot both forward and backward to lock the fence in position. The fence is unlocked when lever 330 extends roughly straight up, and is locked when lever 330 pivots to the front or back. Lever 330 is shown pivoted to the back in FIG. 15. This type of lever is particularly useful for fences that are reversible, or in other words, fences with a non-removable face plate and a fence head at each end and so that the fence is flipped around (i.e., turned 180 degrees) when used on the left side of the blade.

INDUSTRIAL APPLICABILITY

The fences described herein are applicable to woodworking power tool equipment, and particularly to table saws.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. No single feature, function, element or property of the disclosed embodiments is essential to all of the disclosed inventions. Similarly, the recitation of "a" or "a first" element, or the equivalent thereof, should be understood to include incorporation of one or more such elements, neither requiring nor excluding two or more such elements.

It is believed that the following claims particularly point out certain combinations and sub-combinations that are directed to disclosed inventions. Inventions embodied in other combinations and sub-combinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

The invention claimed is:

1. A table saw comprising:

a table having a rail structure and a perimeter, where the perimeter encompasses the rail structure;

a substantially planar, circular blade configured to extend at least partially above the table;

a motor to spin the blade; and a fence configured to lock in a selected position relative to the table, where the fence includes a locking mechanism to lock the fence in the selected position, where the locking mechanism includes a component movable by a user, and where the component is positioned substantially within the perimeter; where the component is configured to be pressed in a direction toward the table by the user to unlock the fence.

2. A table saw comprising:

a table;

a substantially planar, circular blade configured to extend at least partially above the table;

a motor to spin the blade; and a fence configured to lock in a selected position relative to the table, where the fence includes a locking mechanism to lock the fence in the selected position, where the locking mechanism includes a component movable by a user;

where the component is a lever with two ends, where the lever is configured to pivot around an axis between the two ends, and where the lever is further configured so that pressing one end of the lever causes the fence to unlock and pressing the other end of the lever causes the fence to lock.

3. A table saw comprising:

a table having a front and a rear;

a substantially planar, circular blade configured to extend at least partially above the table;

a motor to spin the blade; and a fence configured to lock in a selected position relative to the table, where the fence has an elongate portion extending generally from the front to the rear of the table, where the elongate portion has a top surface, where the fence includes a locking mechanism to lock the fence in the selected position, where the locking mechanism includes an component moveable by a user, where the component is substantially flush with the top surface of the elongate portion of the fence when the fence is locked in the selected position, and where at least a portion of the component is above the top surface of the elongate portion of the fence when the fence is not locked in the selected position.

* * * * *